United States Patent [19]

Wright

[11] Patent Number: 4,607,763

[45] Date of Patent: Aug. 26, 1986

[54] DISPENSER FOR A COLLAPSIBLE TUBE

[76] Inventor: Carl A. Wright, 408 E. Marquette Rd., Chicago, Ill. 60637

[21] Appl. No.: 611,476

[22] Filed: May 17, 1984

[51] Int. Cl.[4] ..... B65D 35/28; B65D 35/56

[52] U.S. Cl. ..... 222/102; 222/105; 222/181; 248/108

[58] Field of Search ..... 222/100, 101, 102, 105, 222/181, 185; 248/108, 109; 312/257 A, 257 R, 312, 306; 220/353

[56] References Cited

U.S. PATENT DOCUMENTS

| | | | |
|---|---|---|---|
| 624,090 | 5/1899 | Ranney | 312/306 X |
| 3,870,198 | 3/1975 | Cohen | 222/105 |
| 4,213,542 | 7/1980 | Wilson | 222/102 |
| 4,418,840 | 12/1983 | Gardner, Sr. | 222/102 X |
| 4,453,634 | 6/1984 | Blumenthal | 220/353 X |
| 4,474,416 | 10/1984 | Rogahn | 312/257 R X |

*Primary Examiner*—Joseph J. Rolla
*Assistant Examiner*—Nils E. Pedersen
*Attorney, Agent, or Firm*—Bernard L. Kleinke

[57] ABSTRACT

A collapsible tube dispenser includes rollers movably mounted in a housing for squeezing a tube, as the rollers roll axially along the tube. The housing is constructed to permit ready installation of a tube to be squeezed. In one form of the invention, the housing includes an open frame, and in another form of the invention, the housing can be quickly disassembled in a convenient manner.

6 Claims, 6 Drawing Figures

DISPENSER FOR A COLLAPSIBLE TUBE

TECHNICAL FIELD

This invention relates in general to a collapsible tube dispenser, and it more particularly relates to a dispenser for metering toothpaste from a collapsible tube.

BACKGROUND ART

There have been many different types and kinds of collapsible tube dispensing devices. For example, reference may be made to the following U.S. Pat. Nos. 1,842,000; 1,975,915; 2,530,327; 3,197,072; 3,297,205; 3,738,533; 3,876,934 and 4,337,879.

While the dispensing devices disclosed in the foregoing patents may be satisfactory for some applications, it would be highly desirable to have a toothpaste tube dispenser, which is very convenient to use. In this regard, it would be highly desirable to have a toothpaste tube dispenser, which is easy to load and which is easy to maintain.

Such a new dispenser should be designed to permit relatively easy installation and removal of a toothpaste tube by everyone, including individuals, such as young children, and elderly and handicapped persons. Such a dispenser should be relatively inexpensive to manufacture, and one which can be readily cleaned.

DISCLOSURE OF INVENTION

Therefore, the principal object of the present invention is to provide a new and improved collapsible tube dispenser, which can be readily used in a very simple and straight forward manner, and which is readily cleanable.

Another object of the present invention is to provide such a new and improved collapsible tube dispenser, which is relatively inexpensive to manufacture, and which is esthetically pleasing in appearance.

Briefly, the above and further objects of the present invention are realized by providing a collapsible tube dispenser, which meters substances, such as toothpaste from a collapsible tube in a convenient manner.

A collapsible tube dispenser includes rollers movably mounted in a housing for squeezing a tube, as the rollers roll axially along the tube. The housing is constructed to permit ready installation of a tube to be squeezed. In one form of the invention, the housing includes an open frame, and in another form of the invention, the housing can be quickly disassembled in a convenient manner.

BRIEF DESCRIPTION OF THE DRAWINGS

The above-mentioned and other objects and features of this invention and the manner of attaining them will become apparent, and the invention itself will be best understood by reference to the following description of the embodiments of the invention taken in conjunction with the accompanying drawings, wherein.

BEST MODE FOR CARRYING OUT THE INVENTION

Figure 1:
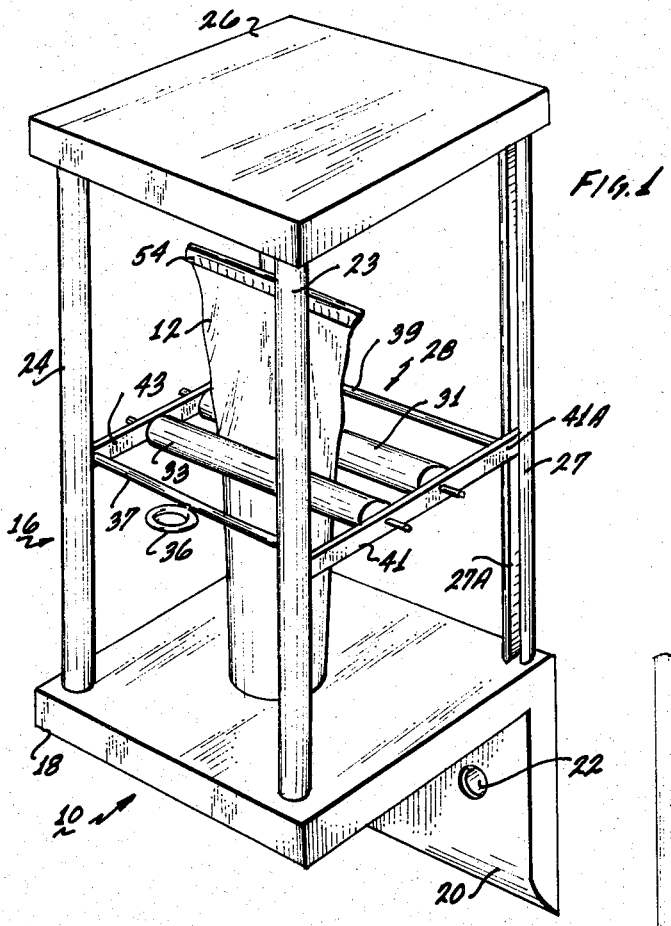
FIG. 1 is a pictorial view of a collapsible tube dispenser, which is constructed in accordance with the present invention.
Figure 2:
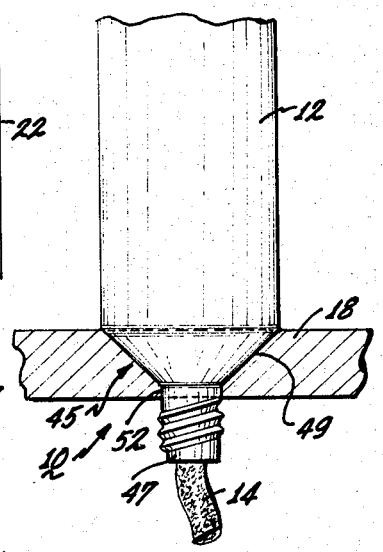
FIG. 2 is an enlarged fragmentary detail view of a base portion of the dispenser of FIG. 1.
Figure 3:
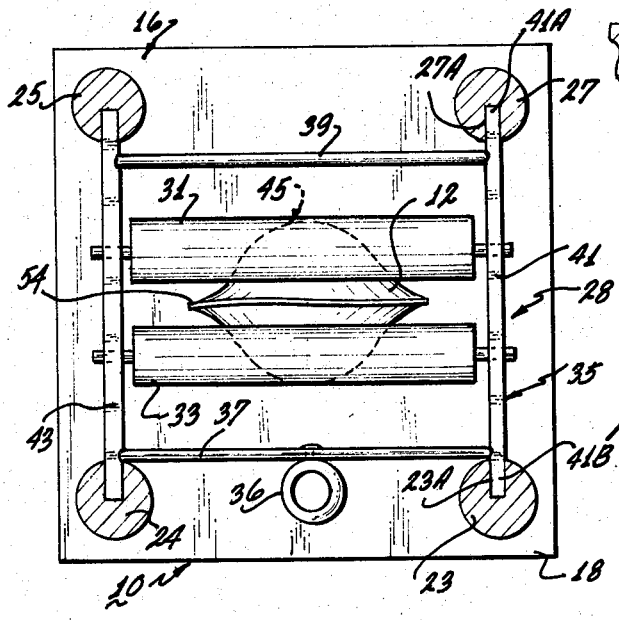
FIG. 3 is a sectional plan view of the dispenser of FIG. 1, drawn to an enlarged scale.

Referring now to the drawings, and more particularly to FIGS. 1, 2 and 3 thereof, there is shown a collapsible tube dispenser 10, which is constructed in accordance with the present invention. The dispenser 10 is adapted to be used with a collapsible toothpaste tube 12 for dispensing toothpaste 14 (FIG. 2) therefrom.

While a toothpaste tube is shown and described herein, it is to be understood by those skilled in the art, that other types and kinds of collapsible tubes, such as shampoo containers, hand creams, and others, may also be used with the dispenser of the present invention.

The dispenser 10 generally comprises a housing generally indicated at 16, having a base 18 which includes a downwardly depending flange 20 adapted to be attached to a mounting surface (not shown), such as a wall. A plurality of mounting holes, such as the hole 22, in the flange 20 is adapted to receive a wood screw (not shown) for mount purposes.

A set of four upstanding rods or posts 23, 24, 25, and 27 extend between the base 18 and a top plate 26 to form an open frame to permit ready access to the tube 12, for loading and unloading purposes, as well as for cleaning the dispenser 10. A roller assembly 28 is slidably mounted on the rods to move upwardly and downwardly for squeezing toothpaste from the toothpaste tube 12, as hereinafter described in greater detail. The roller assembly 28 includes a pair of parallel spaced-apart rollers 31 and 33 for receiving the toothpaste tube 12 therebetween.

Assembly 28 includes a generally rectangular frame 35, which has a ring 36 fixed to the front portion thereof to enable the user to manually pull the rectangular frame 35 downwardly for squeezing the toothpaste from the tube 12.

The rectangular frame 35 generally comprises a pair of side rails 37 and 39, and a pair of end rails 41 and 43 secured between the side rails.

In order to mount the roller assembly 28 slidably on the upstanding rods, each one of the rods, such as the rod 27, includes an elongated groove, such as the elongated groove 27A, for receiving an end portion of the end rails, such as the end portion 41A extending into the groove 27A. As best seen in FIG. 3 of the drawings, the end rail 41 includes an end portion 41B extending into an elongated slot 23A of the rod 23. The elongated grooves extend the length of the rods. The grooves in the rods 23 and 27 face one another to receive the end rail 41. Similarly, the grooves in the rods 24 and 25 face one another and receive the end rail 43.

In order to support the toothpaste tube 12 in an inverted manner as shown in FIG. 1, the base 18 includes a centrally disposed funnel shaped opening 45 for receiving a nozzle or neck portion 47 (FIG. 2) of the tube 12. The funnel shaped opening 45 includes a conically shaped portion 49 and a cylindrical portion 52.

In use, in order to load the dispenser 10 with a fresh tube 12, the user grasps the ring 37 and slides the frame 35 on the roller assembly 28 upwardly to enable the toothpaste tube 12 to be loaded into the dispenser 10. In this regard, after the cap (not shown) is removed from the tube 12, the nozzle 47 of the toothpaste tube 12 is slipped into the central opening 45 in the base 18, and then the rollers 31 and 33 are lowered over the flattened end portion 54 of the tube 12.

In this manner, the tube 12 is ready for dispensing the toothpaste 14 therefrom. By merely pushing downwardly on the ring 37 of the roller assembly 28, to lower it along the tube 12, the rollers 31 and 33 rotate as they move downwardly relative to the toothpaste tube 12 for metering toothpaste from the tube 12. As best shown in FIG. 2, the nozzle 47 extends below the base 18 so that the opened nozzle 47 permits the toothpaste 14 to flow therefrom.

After dispensing a quantity of toothpaste to a toothpaste brush (not shown), the cap (not shown) for the toothpaste tube 12 can be readily threaded back onto the nozzle 47 in a convenient manner.

Once the supply of toothpaste becomes expended, the tube 12 can readily be removed from the dispenser 10 by reversing the loading procedure. In this regard, a roller assembly 28 is slid upwardly to free the upper end of the tube 12 so that it can be easily removed from the opening 45.

The ease of removal or insertion of the tube 12 is facilitated by the fact that the nozzle 47 of the tube 12 is merely inserted into the opening 45 to cause the tube 12 to stand in the inverted position, and the roller assembly supports the opposite end of the tube. Once the roller assembly is slid upwardly away from the tube, it can be freely removed from the dispenser 10.

It should be understood that the base 18, top panel 26, and the upstanding rods define an open frame so that a person can load or unload the toothpaste tube 12 from the housing 16 in a very convenient manner. The loading and unloading operation can be performed in a very simple manner so that young children, the critically ill, elderly, or handicapped persons can readily perform the operation. Also, the dispenser 12 can be conveniently cleaned, once the tube is removed, since any accumulation of toothpaste on the base 18 can be readily wiped clean.

Due to the simplicity of the design of the dispenser 10, the user can immediately determined how to use it. Also, the dispenser 10 is suitably dimensioned to accept different sizes of collapsible tubes, without requiring any adjustments to be made to the unit. The open frame design allows the tube 12 to be exposed to view, since toothpaste tubes and other such tubes are currently sold bearing attractive designs, which add to the esthetically pleasing appearance of the dispenser 10.

Since the dispenser 10 is composed of few parts, which are relatively inexpensive to make and to assemble, the dispenser 10 itself is relatively inexpensive to manufacture. Also, due to the simplicity of the construction of the dispenser 10, it is not susceptible to malfunctioning, and it can be readily repaired, should it become damaged or otherwise broken.

Figure 4:
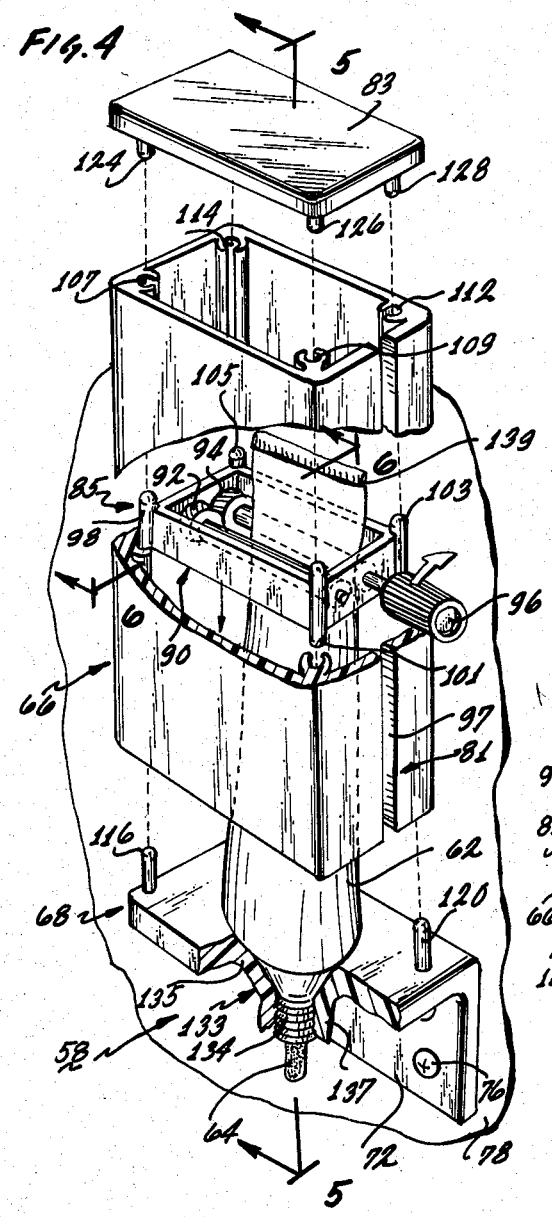
FIG. 4 is a fragmentary, exploded pictorial view of another collapsible tube dispenser, which is also constructed in accordance with the present invention.
Figure 5:
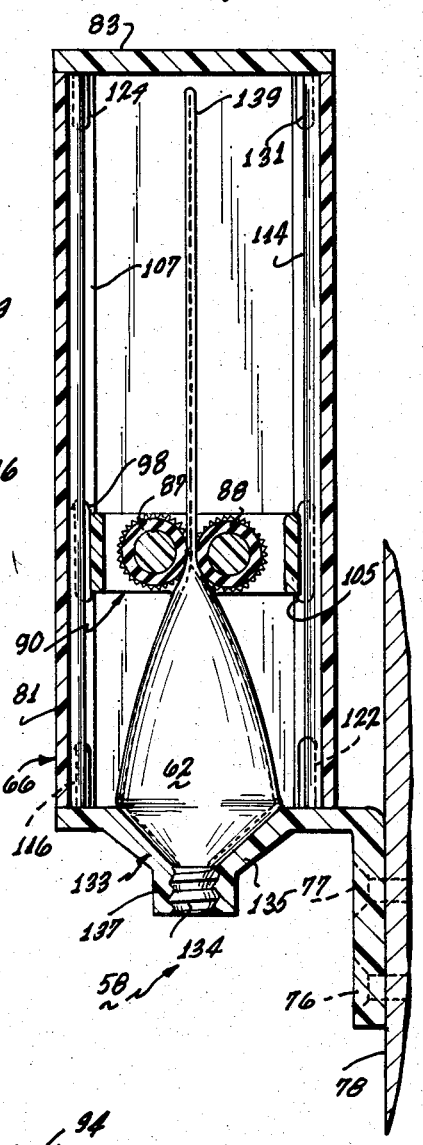
FIG. 5 is a vertical elevational, sectional view of the collapsible tube dispenser taken on line 5—5 of FIG. 4.
Figure 6:
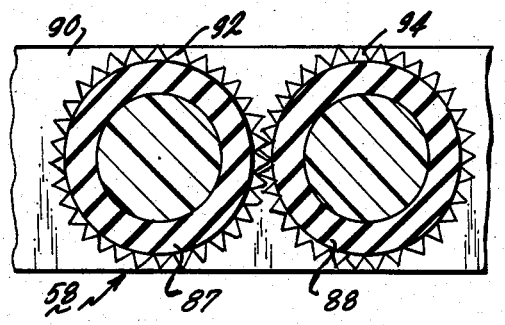
FIG. 6 is an enlarged sectional view of FIG. 4 taken on line 6—6 thereof.

Referring now to FIGS. 4, 5, and 6 of the drawings, there is shown a toothpaste tube dispenser 58, which is adapted to be used with a collapsible toothpaste tube 62 or the like for dispensing toothpaste 64 (FIG. 4) therefrom. The dispenser 58 is similar to the dispenser 10, in that the dispenser 58 can be readily loaded with a toothpaste tube, and is used in a convenient manner. In this regard, the dispenser 58 can be readily taken apart for loading purposes, as well as for cleaning purposes.

The dispenser 58 generally includes a housing 66, having a base 68 which includes a depending flange 72 having openings (not shown) for receiving wood screws, such as the wood screws 76 and 77 to fasten the flange 72 to a suitable supporting surface, such as the wall 78.

The housing 66 includes a hollow tubular body portion 81, which is generally rectangular in cross section throughout its length, and which is quickly detachable from the base 68 to load and unload the dispenser 58 with the tube. The housing 66 is enabled to be extruded from suitable thermoplastic material. A top cover plate 83 is attached removably to the body portion 81. A roller assembly generally indicated at 85 is mounted slidably within the body portion 81. The roller assembly 85 includes a pair of parallel spaced-apart rollers 87 and 88 for receiving the tube 62 therebetween for squeezing toothpaste 64 therefrom. The roller assembly 85 operates in a similar manner as the roller assembly 28 in FIG. 1.

Roller assembly 85 includes a rectangular frame 90 for supporting rotatably the rollers 87 and 88 thereof. A pair of meshing sprocket gears 92 and 94 are mounted on the lefthand ends of the respective rollers 87 and 88. In this regard, a thumb knob 96 is connected to the rear roller 88 and extends through an elongated housing side slot 97 to enable the user to rotate the thumb knob for driving the rear roller 88 into rotation about its axis. In so doing, the sprocket gears 92 and 94 mesh to drive the front roller 87. Thus, as the thumb knob 96 is rotated manually in the direction of the arrow, the rollers rotate drivingly to cause the assembly 85 to move downwardly for squeezing the collapsible toothpaste tube 62 for metering toothpaste 64 therefrom.

In each one of the four corners of the rectangular frame 90, there is disposed integral axially-extending rounded protuberances or pins 98, 101, 103, and 105, which fit slidably within a set of four internal integral grooves 107, 109, 112, and 114, respectively. The grooves extend the entire length of the body portion 81.

A set of four upstanding base pins, such as the pins 116, 120, and 122, fit releasably into the bottom of the respective integral grooves in the body portion 81. Similarly, the set of four depending top pins 124, 126, 128, and 131 extend downwardly from the top cover plate 83 to fit into the upper ends of the respective internal grooves 107, 109, 112, and 114. In this regard, as indicated in FIG. 4, the body portion 81 can be snapped out of engagement with the base 68, and similarly the top cover plate 83 can be snapped out of engagement with the upper end portion of the body portion 81 to disassemble the unit. Once disassembled, the toothpaste tube can be readily loaded in place and the unit can be conveniently cleaned.

In order to load the toothpaste tube 62 into the dispenser 58, it is first snapped apart as indicated in FIG. 4 of the drawings. After removing the cap (not shown) from the tube 62, the toothpaste tube 62 is then inverted to enable its nozzle 134 to slip into a central depending funnel shaped projection 133 in the base 68. The projection includes a conical portion 135 terminating in a cylindrical portion 137.

Once the tube is placed in the inverted position as indicated in the drawings, the body portion 81 is slipped over the flattened rear end 139 of the tube 62 until the rollers 87 and 88 fit over the rear end of the tube 62. Thereafter, the body portion 81 is snapped into engagement with the upstanding pegs of the base 68. Finally, the cover plate 83 is snapped into engagement with the top end of the body portion 81.

In order to dispense toothpaste from the tube, the thumb knob 96 is rotated in the direction of the arrow to cause the rollers to advance downwardly along the tube 62 for dispensing the toothpaste 64 therefrom. Once a quantity of toothpaste has been dispensed, a cap (not shown) is slipped over the outside of the cylindrical portion 137 of the depending projection 133 to seal off the toothpaste tube 62.

Thus, the unit can be readily disassembled for loading a toothpaste tube, and in so doing, the unit can be easily cleaned. Such an operation can be performed in a very quick and simple manner.

While particular embodiments of the present invention have been disclosed, it is to be understood that various different modifications are possible, and are contemplated, within the true spirit and scope of the appended claims. For example, many different types and kinds of materials may be employed for the various portions of the dispensers of the present invention. Such materials include thermoplastic as well as metal materials. There is no intention, therefore, for limitation to the exact abstract or disclosure herein presented.

I claim:

1. A dispenser for metering a substance from a collapsible tube having a discharge nozzle, comprising:

housing means for confining the tube in an inverted position, said housing having a base for supporting the tube from below;

said base having means defining an opening therein for receiving the tube nozzle to help support the tube in an inverted upright manner to enable the tube to be readily inserted or removed from the dispenser in a convenient manner;

roller means movably mounted within said housing for helping support the upper portion of the tube and for squeezing the tube as said roller means moves relative to said tube;

first attaching means for attaching removably said housing to said base to permit access to the dispenser for loading or unloading purposes;

wherein said means defining an opening includes a conical portion and a cylindrical portion to help support the tube;

wherein said housing includes a tubular body portion, a top cover plate, and second attaching means for attaching removably said cover plate to the top end of said body portion;

wherein said roller means generally comprises a support frame having a plurality of spaced apart rollers thereon for receiving and squeezing the tube therebetween;

wherein said roller means is generally rectangular in shape, and has a set of integral slide members at the corners thereof, said body portion has a set of means defining open grooves therein for receiving slidably respective ones of said slide members; and wherein the first attaching means and the second attaching means includes a plurality of connecting devices fixed to the base and to the cover plate, and said means defining grooves receive releasably said devices at the opposite ends thereof to facilitate the assembly and disassembly of said housing.

2. A dispenser according to claim 1, wherein the parts of said dispenser are each composed of thermoplastic material.

3. A dispenser according to claim 1, wherein each one of said devices comprises a peg.

4. A dispenser according to claim 3, wherein said roller means further include gear means mounted on said rollers, and manually movable means connected to a driven one of said rollers for rotating it about its axis to drive the other one of said rollers via said gear means.

5. A dispenser according to claim 4, wherein said body portion includes means defining an elongated side opening therein, through which extends said manual means.

6. A dispenser according to claim 5, wherein said body portion is extruded.

* * * * *